US005769326A

United States Patent [19]

Muchenberger et al.

[11] Patent Number: 5,769,326

[45] Date of Patent: Jun. 23, 1998

[54] DETACHABLE ACCESSORY FITTING FOR INSTALLATION IN A DISCHARGE ORIFICE

[75] Inventors: Claus Muchenberger; Hermann Grether, both of Mullheim, Germany

[73] Assignee: Dieter Wildfang GMBH, Mullheim, Germany

[21] Appl. No.: 621,355

[22] Filed: Mar. 25, 1996

[30] Foreign Application Priority Data

Mar. 24, 1995 [DE] Germany ..... 195 10 734.9

[51] Int. Cl.[6] ..... E03C 1/084

[52] U.S. Cl. ..... 239/428.5; 239/DIG. 23

[58] Field of Search ..... 239/428.5, 590, 239/590.3, 590.5, 600, DIG. 23

[56] References Cited

U.S. PATENT DOCUMENTS

| | | | |
|---|---|---|---|
| 3,143,299 | 8/1964 | Benjamin | 239/590.3 X |
| 3,697,002 | 10/1972 | Parkison | 239/535 |
| 4,000,857 | 1/1977 | Moen | 239/428.5 |
| 4,345,719 | 8/1982 | Bock | 239/428.5 |
| 4,470,546 | 9/1984 | Wildfang | 239/428.5 |
| 4,824,021 | 4/1989 | Binder | 239/DIG. 23 X |
| 5,114,072 | 5/1992 | Barhydt | 239/428.5 |
| 5,356,079 | 10/1994 | Rahbar | 239/600 X |
| 5,467,929 | 11/1995 | Bosio | 239/428.5 |
| 5,495,985 | 3/1996 | Nelson | 239/590.3 X |

FOREIGN PATENT DOCUMENTS

| | | |
|---|---|---|
| 208958 | 1/1987 | European Pat. Off. . |
| 3817270 | 11/1989 | Germany . |
| 4108521 | 9/1992 | Germany . |
| 9314925 | 1/1994 | Germany . |

*Primary Examiner*—Andres Kashnikow
*Assistant Examiner*—Robin O. Evans
*Attorney, Agent, or Firm*—Dallett Hoopes

[57] ABSTRACT

This assembly is compact and includes filtering, flow-controlling and aerator elements held together with snap-fastener-type connectors.

5 Claims, 2 Drawing Sheets

DETACHABLE ACCESSORY FITTING FOR INSTALLATION IN A DISCHARGE ORIFICE

BACKGROUND OF THE INVENTION

This invention relates to a flow-modifying assembly for installation in a discharge orifice. It includes detachable elements.

Flow-modifying assemblies are already known in various forms. Depending on the purpose for installation and use, flow-through volume controllers in discharge orifices are combined with aerators. The individual elements are stacked one on the other in the flow-through direction of the orifice, the consequence of which is a correspondingly large overall length. Also, the sealing between the individual elements is a problem. In addition, during and after installation and equipping of the discharge orifice, there is a danger that the elements that are loosely held to each other will fall out. This is also disadvantageous for automated manufacturing, assembly and packing of such elements in a discharge orifice.

Therefore, the object of this invention in particular is to create an easily manipulable and functionally safe assembly of the type described above.

SUMMARY OF THE INVENTION

The invention in a discharge orifice assembly is an attachment filter placed upstream on the in-flow side of a flow-through volume controller, the attachment filter and the flow-through volume controller being detachably connectable to each other by means of mating connectors.

By means of the detachable connection between the through-flow volume controller on the one hand and the attachment filter on the other hand, manipulation during and after installation, as well as equipping the discharge orifice is made substantially simpler. This is because these elements readily separate from each other and can be disassembled. Owing to the close connection of the mating elements, they tightly adjoin each other, which allows for a comparatively small overall length.

The functional safety of the assembly of the invention is also assured by having a filter attachment upstream of the flow-through volume controller, keeping possible foreign particles away from the volume controller. These particles otherwise could lead to malfunctions and particular to irregular throughput of the volume controller.

To create a soft, spray-free water stream, it is appropriate to provide an aerator as an additional component part. This is placed downstream of the flow-through volume controller in the out-flow. It is appropriate that the aerator and the flow-through volume controller be detachably connectable to each other by means of connectors that can cooperate with each other. Particularly in the case of a multi-part assembly, manipulation during installation in the discharge orifice is made substantially simpler. With this embodiment form also, in accord with the invention, the assembly elements lie close together. Therefore, despite the multi-piece configuration, what is attained is a comparatively small overall length for this assembly.

To avoid misassembly, it is preferable for the connectors provided between the aerator and the flow-through volume controller on the one hand, and the connectors situated between the flow-through volume controller and the attachment filter on the other hand, do not complement each other. However, in a more preferred development according to the invention, the elements themselves in each case are formed with connectors that mate with each other for optional connection of the aerator with the downstream end of upstream units; either the flow-through volume controller and/or the attachment filter. The connectors provided on the attaching components are compatible with each other in this more preferred form. Therefore, depending on the requirements, the assembly of the invention can be assembled from the individual elements in the desired order and combination.

A further benefit of the invention is that one attachment filter hereunder can be attached as desired either to the aerator or to the flow-through volume controller. A further object of the invention is that an assembly may be "custom tailored" to meet specific requirements. This also reduces storage requirements because no finished discharge orifices with the various possible combination and arrangements of elements need to be stocked.

Preferably the connectors of the elements are formed of snap-type fasteners. By this means, the connection of the individual mounting parts to each other is done in a simple way by compressing together the aligned elements. Such snap fastener connections are easy to implement by resilient parts, and they also result in a sufficiently sturdy connection. To avoid misassembly, it is preferred to have the downstream-facing fastener parts of one sex (for instance, the "socket") and the upstream-facing fastener parts of the opposite sex (for instance, the "head").

It is also preferable to have edge recesses, preferably chamferings, provided on the elements, particularly adjacent their contiguous surfaces. By this means, separation of the connected mounting parts is facilitated, for example, if a flow-through volume controller must be replaced by another one with a different flow-through rate.

BRIEF DESCRIPTION OF THE DRAWINGS

Other objects and features of the invention understandable to those skilled in the are presented in the following specification and shown in the drawings, all of which disclose non-limiting embodiments. In the drawings.

DESCRIPTION OF PREFERRED EMBODIMENT

Figure 1:
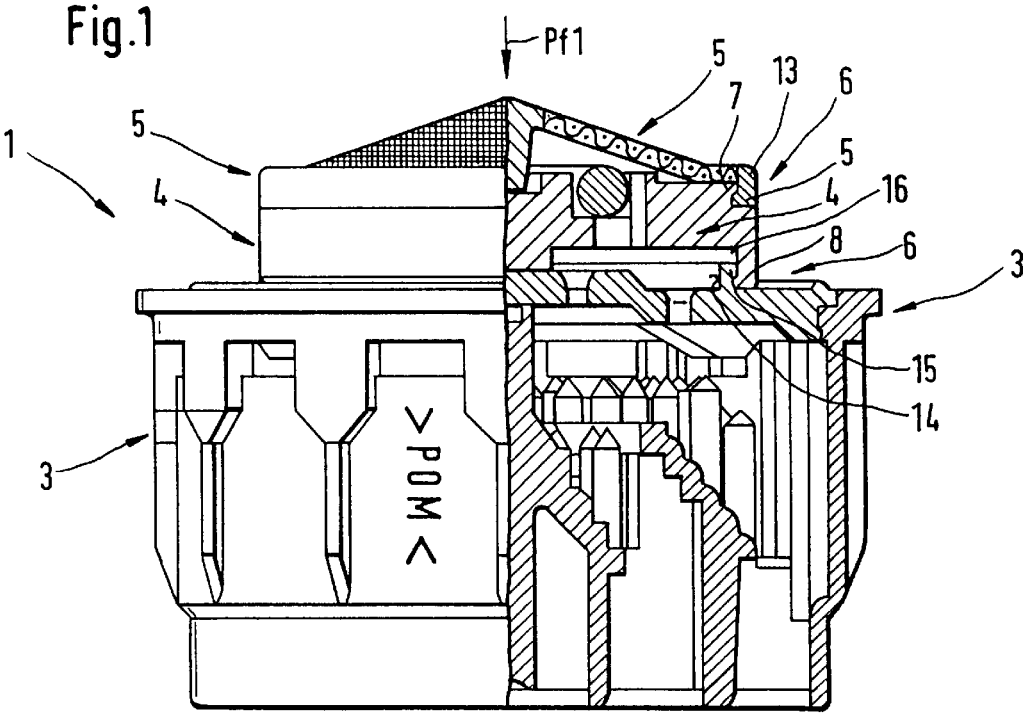
FIG. 1 is a side elevational view of an assembly embodying the invention, depicted in semi-lateral cross section.

A flow-modifying assembly is shown in FIG. 1 and generally designated 1. It is disposed in a discharge orifice 2 as is shown, for example, in FIG. 2. The discharge orifice is connectable with the discharge end of a sanitary fitting.

The assembly 1 (FIG. 1) is essentially of three elements and comprises an aerator 3, a flow-through volume controller 4 and a filter attachment 5. The flow direction is designated by the arrow Pf1.

The aerator element 3 serves for shaping the water into a soft, spray-free stream. It may be of the type shown and disclosed earlier in U.S. Pat. No. 5,495,985 which issued Mar. 5, 1996 to our assignee. The flow-through volume controller element 4 serves for a largely water-pressure-independent limitation of flow-through performance. The attachment filter 5 lastly serves to keep solid particles accompanying the water away from the flow-through volume controller and the aerator, to ensure that they function properly and are not impaired.

Depending on the application, various combinations of elements are provided. As an example, flow-through volume controllers 4 can be used having various flow-through rates. There is also the option of using the aerator 3 with a directly placed attachment filter 5 if no flow-through volume controller 4 is needed.

To be able to attach mounting parts 3, 4, 5 optionally with each other, they themselves have connectors 6 that adapt in each case to each other (FIG. 1). Such connectors 6 are found on the aerator 3 on its in-flow side end, on the flow-through volume controller 4 at both ends, and on the attachment filter 5 on its out-flow side end.

To obviate misassembly, however, it is also possible to configure mounting parts 3, 4 and 5 so that the connectors 6 between aerator 3 and flow-through volume controller 4 on the one hand, and the connectors 6 placed between flow-through volume controller 4 and the filter attachment 5 on the other hand, are not compatible with each other. However, what is preferred is the embodiment shape depicted here in which the connector 6 adapts all the elements 3, 4, 5 to each other.

Figure 4:
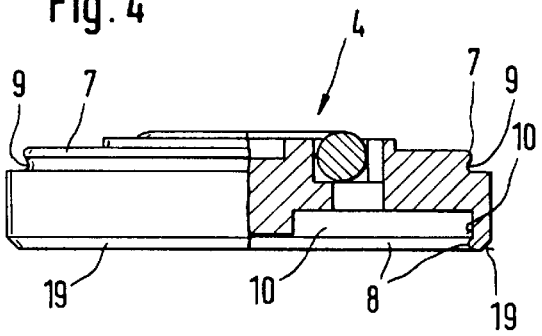
FIG. 4 is a side elevational view of a flow-through volume controller show n semi-laterally in cross section.

As can easily be perceived in FIG. 1 and also FIG. 4, the connectors of the mounting parts are formed by snap connections. By this means the mounting parts can be aligned one on another and snapped together by pressure action. In the embodiment example, in the attachment connections, encircling ring bulges with undercuts are provided as connectors 6.

FIG. 4 shows ring bulge 7 pointing radially outwards on the in-flow side of the flow-through volume controller 4 with an undercut 9 adjoining it in the axial direction. By this means an attachment connection (male) is created for the attachment filter 5 that can be placed there. This attachment filter has an appropriate complementary attachment connection (female). On the inner side on an encircling edge 13 (see FIG. 6) of the attachment filter 5 is a ring bulge 11 pointing inward, with an undercut 12 adjacent. The ring bulges are formed rounded or have lead-in chamferings on their outer ends, so that approach slopes are formed which facilitate snapping together the mounting parts to be joined to each other.

The connectors between the flow-through volume controller 4 and the aerator 3 are configured in similar fashion, the flow- through volume controller exhibiting on its outflow side (female) end a ring bulge 8 (FIG. 6) that points inward and an undercut 10 adjoining it. Complementary to this the aerator 3 (FIG. 1) exhibits on an encircling annular web 14 (male) a ring bulge 15 that points outward with an undercut 16 adjoining it.

Through the same, or complementary, configurations of connectors, there is an option of attaching the filter attachment 5 either onto the flow-through volume controller 4 or directly to the aerator 3.

Preferably, the ring bulges are configured as closed encircling ones, so that in this transition or separating zone the result is a tight connection, making additional sealing unnecessary. Thus there is a mechanical connection and also a sealing at the same time.

Figure 2:
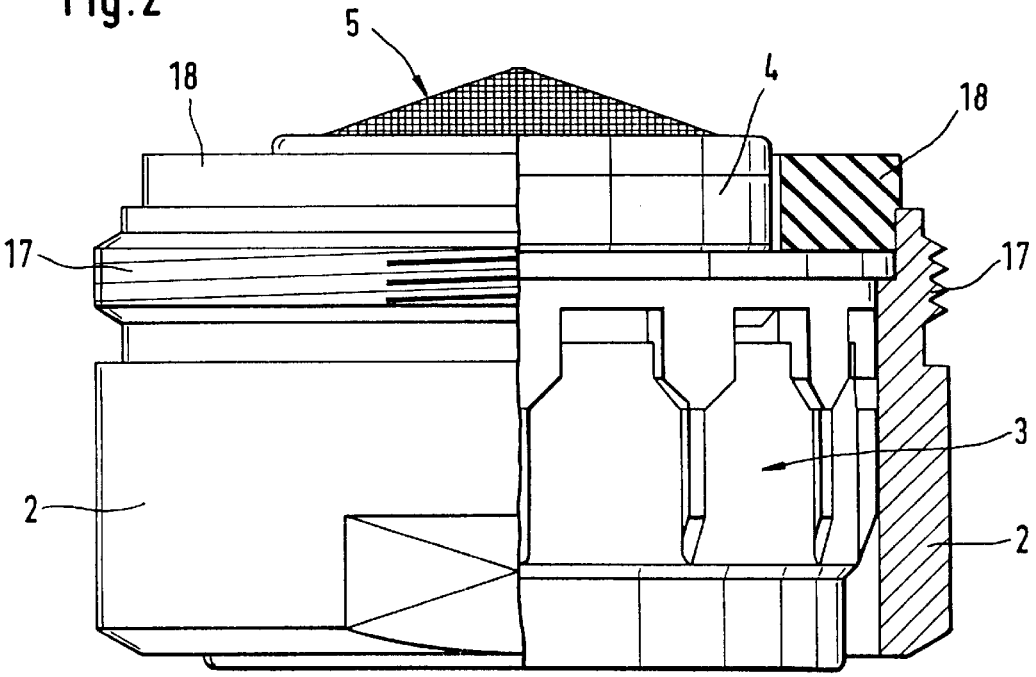
FIG. 2 is also a side elevational view of an assembly disposed in a discharge orifice, also in semi-lateral section.

FIG. 2 shows a mounting part fitting in accord with FIG. 1, placed in a discharge orifice 2 that on its in-flow side end exhibits a threaded connection 17 to link with a sanitary fitting (not shown). Here it can be clearly seen that the entire assembly 1 exhibits a comparatively small overall length owing to the direct connection of elements in every instance, and projects only slightly over the axial length of discharge orifice 2. Thus, the conventional and familiar discharge orifice 2, is usable with the aerator 3 and filter 5.

Controller 4 exhibits a smaller exterior diameter than aerator 3, so that it fits inside the ring seal 18 placed on the outer edge of aerator 3. This accomplishes two things. For one, direct connection with the aerator 3 is possible without additional ring seals. For another, as already mentioned previously, a compact structural shape is possible with a short overall length.

Figure 3:
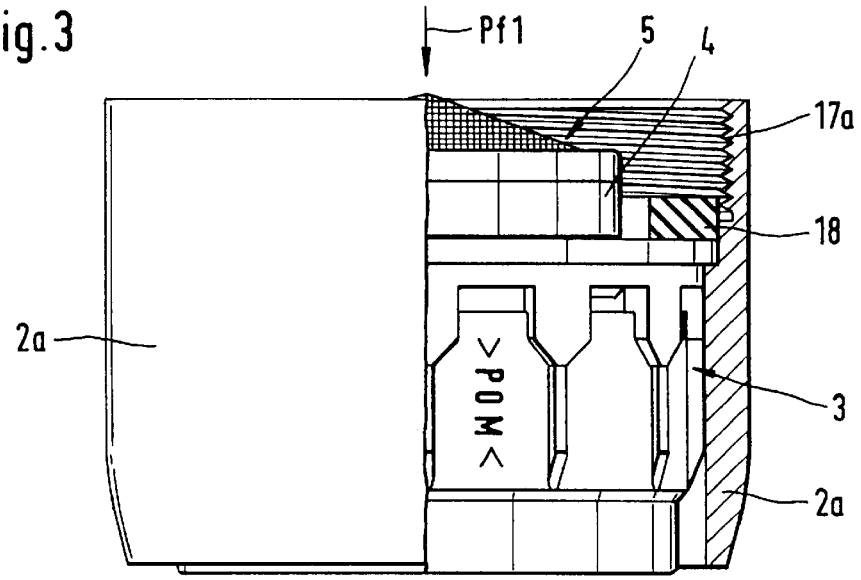
FIG. 3 is a view similar to FIG. 2 of an assembly disposed in a discharge orifice that is modified from that in FIG. 2.

In accord with FIG. 3, the assembly 1 is used in another discharge orifice 2*a*, which exhibits an interior attachment threading 17*a* to achieve a connection with a sanitary fitting (not shown). In this embodiment shape it can be seen that the entire mounting part fitting has space inside the discharge orifice 2*a*. Here also, a customary discharge orifice 2*a*, used previously, can be employed without alteration.

Figure 5:
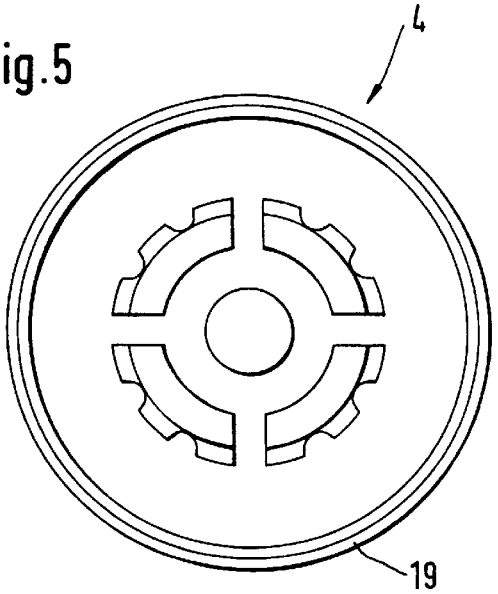
FIG. 5 is a bottom plan view of the flow-through volume controller shown in FIG. 4.
Figure 6:
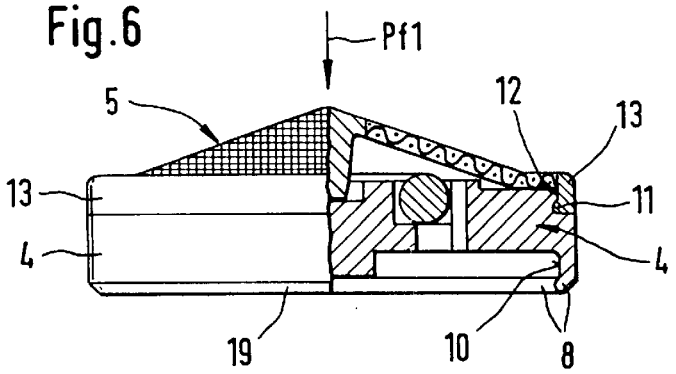
FIG. 6 is a side elevational view of a flow-through volume controller shown in semi-lateral cross section, with an attachment filter snapped onto the in-flow side.

It can easily be seen in FIGS. 4 to 6 that a chamfering 19 is found in the division between the flow-through volume controller 4 and the aerator 3, in the area of the ring bulge 8 on the outer side. In effect this chamfering forms an edge recess. For example, a fingernail can be inserted into it and the flow-through volume controller 4 can then be separated from the aerator. Thus, no additional auxiliary tools are needed to effect the separation, and also none to join the elements. A chamfering similar to that on the out-flow site connection end of the flow-through volume controller 4 could also be located on the outer side at the ring bulge 11 of the filter 5.

FIGS. 1, 4 and 6 also allow one to see easily that the connectors with the ring bulges and the undercuts are arrayed so that a smooth annular exterior surface results when the elements are placed together.

The present invention provides a flow-modifying assembly that is compact, safe and easy to assemble from its components without the use of tools. The safety is attributable to the presence of a pre-controller filter attachment and the compactness and ease of assembly stems from the snap-fastener-type connectors between the elements. It permits rearrangement of elements and the tailoring of element combinations for special purposes. Misassembly is obviated by the orientation of the connectors. The connectors effect a sealing function. It is clear that the present invention fills a long-felt need.

Variations in the process of the invention are contemplated. Thus, while the invention is disclosed in a limited number of embodiments, it is limited only by the following claim language which may be extended by an enlargement of the right to exclude as is appropriate under the doctrine of equivalents.

What is claimed is:

1. A flow-modifying assembly for installation in a discharge orifice of a sanitary fitting comprising in stacked relation elements each having an upstream and a downstream side, the elements comprising in order approaching the upstream direction an aerator element having an annular resilient male connector on its upstream side, a flow-through volume controller element having an annular resilient male connector on its upstream side and an annular female resilient connector on its downstream side and a filter element having a resilient annular female connector on its downstream side, the male connectors having the same diameter and configuration and the female connectors having the same diameter and configuration and the male and female connectors of adjacent elements being interengaged, whereby the interengaged connectors can be disengaged and the male connector on the aerator element and the female connector on the filter element can be interengaged to each other in the absence of the volume controller element.

2. A flow-modifying assembly as claimed in claim 1 wherein each connector part comprises a longitudinal annular surface having a bulge at its end more proximate the adjacent element and the engagement is a snap engagement.

3. A flow-modifying assembly as claimed in claim 1 wherein at least one of the elements is formed with a peripheral chamfered edge.

4. A flow-modifying assembly as claimed in claim 1 wherein the connector parts are co-axial with the axis of the elements.

5. A flow-modifying assembly as claimed in claim 1 wherein the snap engagement also effects a seal.

* * * * *